United States Patent [19]

Hunts

[11] Patent Number: 4,970,788

[45] Date of Patent: Nov. 20, 1990

[54] VACUUM-POWERED HAIR CUTTING GUIDE

[76] Inventor: Rick E. Hunts, 885 Barsby, Vista, Calif. 92083

[21] Appl. No.: 408,810

[22] Filed: Sep. 18, 1989

Related U.S. Application Data

[63] Continuation-in-part of Ser. No. 90,594, Aug. 28, 1987.

[51] Int. Cl.[5] ..... B26D 19/44

[52] U.S. Cl. ..... 30/133; 30/233

[58] Field of Search ..... 30/133, 41.5, 132, 233, 30/200, 201

[56] References Cited

U.S. PATENT DOCUMENTS

| | | | |
|---|---|---|---|
| 4,188,720 | 2/1980 | Korf | 30/133 |
| 4,380,870 | 4/1983 | Otto . . | |
| 4,679,322 | 7/1987 | Hunts | 30/133 |

*Primary Examiner*—Douglas D. Watts

*Attorney, Agent, or Firm*—Henri J. A. Charmasson

[57] ABSTRACT

A precision hair-clipping guide for cutting the hair of a subject to a uniform length at a selectable spacing from the subject's scalp. The guide attaches to the end of a vacuum cleaner hose and defines a flow-chamber having a slot through which the blades of clipping scissors may be manipulated while the hair is being drawn into the housing by vacuum.

6 Claims, 1 Drawing Sheet

VACUUM-POWERED HAIR CUTTING GUIDE

PRIOR APPLICATION

This is a continuation-in-part of copending application Ser. No. 07/090,594 filed Aug. 28, 1987.

BACKGROUND OF THE INVENTION

Many modern hairstyles require that the hair be cut to fairly precisely equal lengths in order for the hairdo to be effective. It is, of course, quite difficult to accurately judge the relative lengths of different shocks of hair when the cutting is being done by the comb and scissors method, one shock of hair at a time. This has led to the development of various jigs, spacers and braces used in combination with electric clippers. The most significant improvement in this area was achieved in the stylist hair clipper device disclosed in my U.S. Pat. No. 4,679,322 where shocks of hair are drawn into the clipper housing by vacuum, passing through a series of reciprocating blade slots. When used with a series of spacers, this kind of device can yield a very uniform haircut, and has the added advantage of evacuating all the hair clippings into the vacuum cleaner.

Yet, some hair stylists who routinely use the vacuum-powered hair clipper, must use clipping shears, once in a while, in the finishing phase of a hairdo, or to perform some particularly demanding styles of hair cutting. In doing so, they could benefit from the spacing and evacuating features of the prior device.

SUMMARY OF THE INVENTION

The present invention offers a hair-clipping guide to be used with hair-clipping shears, but which evacuates all the hair clippings through attachment to a household vacuum cleaner hose. Various spacers may be attached to the guide to achieve a variety of hair-clipping styles.

DESCRIPTION OF THE PREFERRED EMBODIMENT OF THE INVENTION

Figure 1:
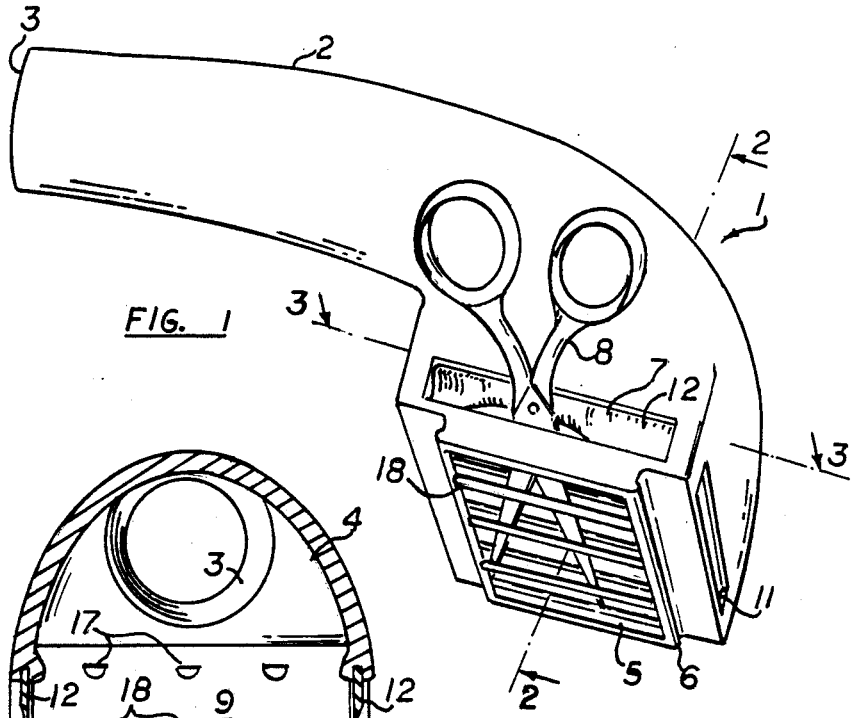
FIG. 1 is a perspective view of the hair-styling guide showing a pair of hair-clipping shears in working position.
Figure 2:
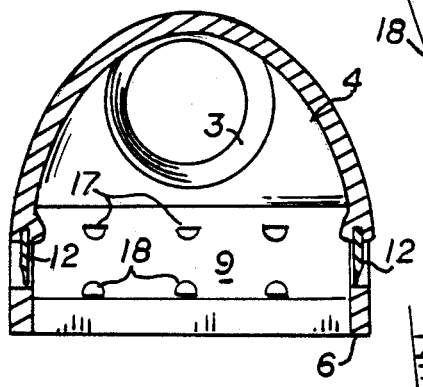
FIG. 2 is a cross-sectional view taken along lines 2—2 of FIG. 1.

Referring now to the drawing, there is illustrated a hair-clipping guide 1. The tubular handle 2 terminates in an outlet 3 which is attachable to the hose of a vacuum cleaner or to any other convenient vacuum source. The main body of the guide defines a air-flow chamber 4 with in inlet 5 ringed by a generally planar rim 6.

A slot 7 in one of the lateral walls of the device is positioned and dimensioned to allow the introduction of the blades of hair-clipping scissors 8. When the rim 6 of the device the width of the slot 7 extends across the entire width of the air-flow chamber 4, so that the scissors 8 can be moved through the slot 7 in their open or closed position is brought in contact with the head of a subject, shocks of hair are drawn by the vacuum through the inlet 5 and into the air-flow chamber 4 where they can be clipped by manipulating scissors 8.

The slot 7 gives access to a clipping area 9 at the entrance of the flow-chamber 4. The work area 9 lies parallel to the plane of the rim 6. A second slot 10 parallel to the first one is located in the opposite wall across the hair clipping area 9. A third slot 11 in the frontal section of the device is also provided so that hair-clipping can be performed in three separate directions. Each slot is closed by a flexible curtain 12 made from a strip of rubber or other flexible material. The curtains 12 allow the easy introduction of the blades of the scissors 8 into the work area 9, while preventing excessive outside air from being sucked up through the slots.

Figure 4:
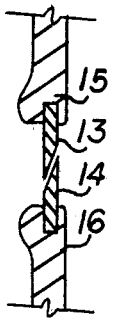
FIG.4 is a detail cross-sectional view of a slot-barrier.

FIG. 4 illustrates an alternate resealable closure for each slot which consists of two separate and overlapping curtains 13 and 14 attached to the two longer edges 15 and 16 of a slot.

A series of upper cross-bars 17 and lower cross-bars 18 span the upper and lower limits of the work area 9. The cross-bars are designed to keep the blades of the scissors 8 within the work area 9. The profile of the cross-bar facing the work area 9 has been rounded or tapered to provide sliding contacts with the tips of the scissors 8.

Figure 3:
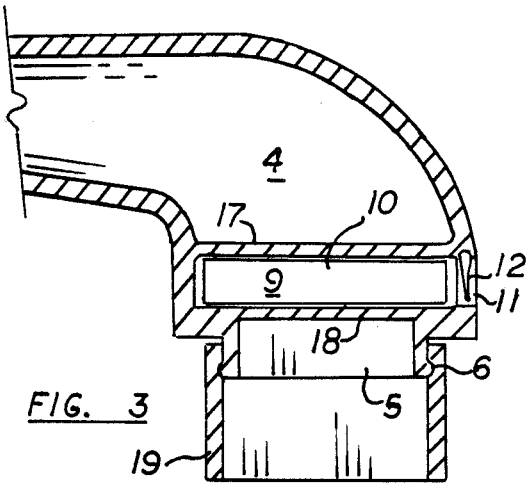
FIG. 3 is a partial cross-sectional view taken along lines 3—3 of FIG. 1, also showing a spacer.

A series of spacers such as the one 19 illustrated in FIG. 3 can be fitted on the rim 6 to determine the hair-cutting length for a more graduated style of hair-clipping. For instance, a short spacer or no spacer at all may used around the ears and lower neck, while a longer spacer may be used for the top of the scalp. Several sizes and styles of such spacers that were disclosed in my previous U.S. Pat. No. 4,679,322 could be used with the instant device.

While the preferred embodiment of the invention has been described, modifications could be made to it, and other embodiments could be devised without departing from the spirit of the invention and the scope of the appended claims.

What is claimed is:

1. A precision air-clipping guide which comprises:

a housing defining an elongated flow-chamber having an inlet into which air can be drawn by vacuum suction, and an outlet connectable to a vacuum source;

said inlet defining a rim lying in a first plane;

said housing having a lateral slot parallel and proximate to said rim, said slot being dimensioned to allow the introduction of the blades of hair-clipping scissors in an open position therethrough;

to manipulate said blades within a second plane generally parallel to said first plane; and guiding means within said flow chamber to keep said blade within said second plane;

wherein said guiding means comprise a first set of cross-bars spanning said flow chamber in a third plane parallel to an between said first and second planes.

2. The hair-clipping guide of claim 1, wherein said guiding means further comprises a second set of cross-bars spanning said flow-chamber in a fourth plane wherein said third and fourth planes are lying on opposite sides of said second plane to define a blade working area.

3. A precision air-clipping guide which comprises:

a housing defining an elongated flow-chamber having an inlet into which air can be drawn by vacuum suction, and an outlet connectable to a vacuum source;

said inlet defining a rim lying in a first plane;

said housing having a lateral slot parallel and proximate to said rim, said slot being dimensioned to allow the introduction of the blades of hair-clipping scissors in an open position therethrough;

to manipulate said blades within a second plane generally parallel to said first plane; and guiding means within said flow chamber to keep said blade within said second plane;

wherein said enclosure has a second slot parallel to an opposite said first slot across the flow-chamber. has a second slot parallel to and opposite said first slot across the flow-chamber.

4. The hair-clipping guide of claim 1 which further comprises a movable air-barrier across said first slot.

5. The hair-clipping guide of claim 4, wherein said air-barrier comprises a strip of flexible material hung across said slot.

6. The hair-clipping guide of claim 5, wherein said strip is made of rubber.

* * * * *